United States Patent [19]

Zatopek et al.

[11] Patent Number: 4,951,911

[45] Date of Patent: Aug. 28, 1990

[54] PORTABLE GAME SUPPORT

[75] Inventors: Edward J. Zatopek; Alfred R. Guglielmo, both of Baton Rouge, La.

[73] Assignee: Orenid, Inc., Baton Rouge, La. ; a part interest

[21] Appl. No.: 407,757

[22] Filed: Sep. 15, 1989

[51] Int. Cl.[5] ..... F16B 47/00

[52] U.S. Cl. ..... 248/362

[58] Field of Search ..... 248/680, 681, 537, 519, 248/511, 205.5, 205.6, 205.7, 205.8, 205.9, 206.1, 206.2, 206.3, 206.4, 362, 363, 910; 269/21; 294/64.1, 65

[56] References Cited

U.S. PATENT DOCUMENTS

| | | | |
|---|---|---|---|
| 1,801,305 | 4/1931 | Drake | 294/65 |
| 2,818,254 | 12/1957 | Dunn | 248/910 |
| 3,055,694 | 9/1962 | Billner | 294/65 |
| 3,165,217 | 1/1965 | Harris | 294/65 |
| 3,602,543 | 8/1971 | Sjodin | 294/64.1 |
| 4,073,462 | 2/1978 | Whitaker | 248/537 |

*Primary Examiner*—Ramon O. Ramirez
*Assistant Examiner*—Robert A. Olson
*Attorney, Agent, or Firm*—Dressler, Goldsmith, Shore, Sutker & Milnamow, Ltd.

[57] ABSTRACT

A portable game support is disclosed which is constituted by, in combination, support means adapted to support game equipment in a stationary elevated position as the game proceeds, and a horizontal, rigid, gas-impervious platform, the support means being mounted upon the platform. Means are provided, to position the platform above the floor to provide a space therebetween, and resilient means surround the platform to seal the platform to the floor when the space between the platform and the floor is evacuated. The platform includes means for interconnecting the underside of the platform with pump means for providing a desired vacuum to maintain a strong securement between the platform and the floor as the game proceeds.

9 Claims, 1 Drawing Sheet

PORTABLE GAME SUPPORT

DESCRIPTION

1. Technical Field

This invention relates to portable game supports, such as basketball hoops, which must remain in a stationary elevated position as the game proceeds, even when subjected to considerable forces, including impact forces.

2. Various games, such as basketball and water polo, require that game equipment be supported in a stationary elevated position as the game proceeds. In some instances the required equipment, typically the backboard and the hoop supported thereby, which are used in games such as basketball, are permanently installed in the gymnasium floor. In most instances the gymnasium facility must be used for other purposes from time to time, and it is desired to remove the game equipment to make the facility better adapted for its different purpose. This has introduced considerable difficulty and expense.

To illustrate, it is common today to mount the equipment from the ceiling of the gymnasium so that the equipment can be elevated in one way or another to move it out of the way, albeit the equipment is still visible. One can also bolt the equipment to the floor, in which case it can be unbolted and removed. No matter what expedient is employed, considerable expense and/or effort is involved. The purpose of this invention is to minimize the expense and effort which is needed to remove the game equipment and to reinstall it when it is desired to once again have the gymnasium ready for the game to be played.

It is also known to employ temporary securement means, such as suction cups, and this does allow one to remove the game equipment whenever desired and to reinstall it as needed. Unfortunately, the suction cups are weak and come loose with impact. Moreover, the strength of the securement must be maintained with time, and the tendency of suction cups is to lose strength with time, especially where the floor to which they are secured has not been specially prepared. As a result, the suction cup technique has attracted little interest.

The use of suction cups is illustrated by U.S. Pat. No. 2,818,254 in which suction cups are attached at the three bottom corners of a triangular platform on which is mounted the game equipment to be supported.

Magnetic means have been used, and are now in use in hockey, where the frequent dislodging of the goal net introduces difficulty because the game must be stopped whenever this occurs.

Weights have also been used, but now securement strength requires using very large weights. Nonetheless, even large weights provide little impact resistance, and the game equipment tends to slide and move out of position when a player hits it or crashes into it.

SUMMARY OF INVENTION

In accordance with this invention, we have found that when the game equipment is mounted upon a horizontal, rigid, gas-impervious platform which is positioned above the floor with a resilient means surrounding the platform and sealing that platform to the floor, and when the space between the platform and the floor being evacuated and the vacuum being maintained as the game proceeds, the game equipment is very strongly supported and resists impact forces and sliding motion in response thereto. When the game is over, the vacuum can be relieved and the platform with the game equipment mounted thereon can be easily removed and reinstalled as desired.

The invention thus provides portable game equipment which is a combination of support means adapted to support game equipment in a stationary elevated position as the game proceeds and a horizontal platform, the equipment being mounted upon the platform.

All sorts of ordinary floors are contemplated, and many of these are rough-surfaced, such as concrete, or are grooved at their surface, such as a wooden floor, so that the seal between the flexible element which supports the platform and the floor will not be perfect, or even approximately perfect. This is probably one reason why suction cups have never been acceptable for the mounting of game equipment. The present invention allows vacuum to be used with all sorts of floors, such as those noted above, as well as bituminous pavements, and the like.

The flexible sealing elements in this invention may be made of synthetic or natural rubbers or miscellaneous plastic materials, such as plasticized polyvinyl chloride or polypropylene. These materials are thermoplastic and may be molded to desired shape.

The vacuum pump is preferably operated continuously because the seal with the floor is usually unreliable and an applied vacuum will not persist for more than a few minutes. This simplifies the structure at the same time that it accommodates the practical problem of handling unprepared floors of various materials and structure. On the other hand, areas of a floor may be specially prepared to provide a superior seal, as with a smooth coating, and in such instance the vacuum can be applied intermittently using a timer to turn the pump on and off, or employing a sensor to monitor the strength of the vacuum and to actuate the pump whenever the pressure is too high.

In larger structures it is preferred to use a sensor, as described above. The sensor can be located in the tube connecting the vacuum pump with the evacuated space beneath the platform, or it can be located within the evacuated space. All that is needed is an electrical connection between the sensor and the pump.

A rigid platform only 2–10 feet on each side can easily provide enough surface area to generate a very large force holding the platform to the floor beneath it when a substantial vacuum is present. But when the pressure rises so that the vacuum becomes less effective, the force becomes inadequate. Unless the vacuum is replenished continuously, or as needed, the platform can be moved by the impacts which it may have to sustain as the game progresses.

The vacuum pump is preferably mounted on the platform, but it can be positioned on the floor near the platform since it is merely necessary to have the platform contain an upstanding connector to allow the pump to be tube-connected to the evacuated space.

The pump is preferably electrically operated so that the desired low pressure can be maintained by simply plugging the air pump into the nearest electrical outlet. In the field where electricity is not available, the pump can be powered with a small gasoline-fueled motor.

DETAILED DESCRIPTION OF INVENTION

The invention will now be described in connection with the accompanying drawings in which.

Figure 1:
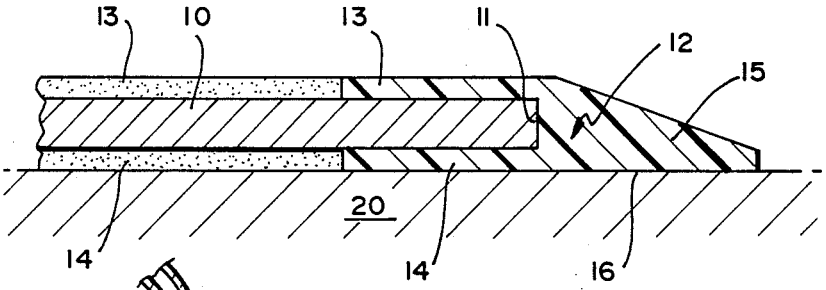
FIG. 1 is a partial cross-section illustrating a simplified form of the invention.

Referring more particularly to FIG. 1, the numeral 10 identified a metal base plate or rigid platform having its outer periphery 11 inserted into a U-shaped socket molded into a resilient flange 12. This socket is defined between upper and lower webs 13 and 14, and these merge into an outer portion 15 having a lower surface 16 which lies in the same plane as the lower surface of the web 14.

The platform 10 supports game equipment, not show in FIG. 1. The combination of platform 10 and peripheral resilient flange 12 sits on a floor 20, and the lower web 14 elevates the platform above the floor to define a space 21 which is evacuated by a vacuum pump not shown in FIG. 1.

Figure 2:
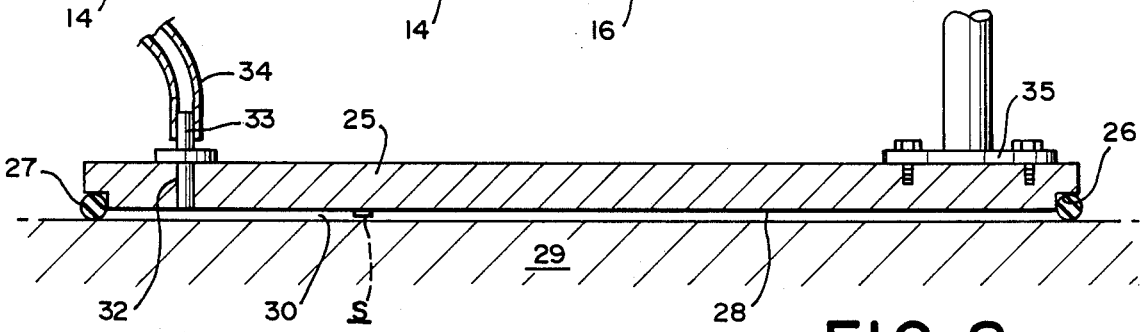
FIG. 2 is a cross-section showing another simplified form of the invention.
Figure 3:
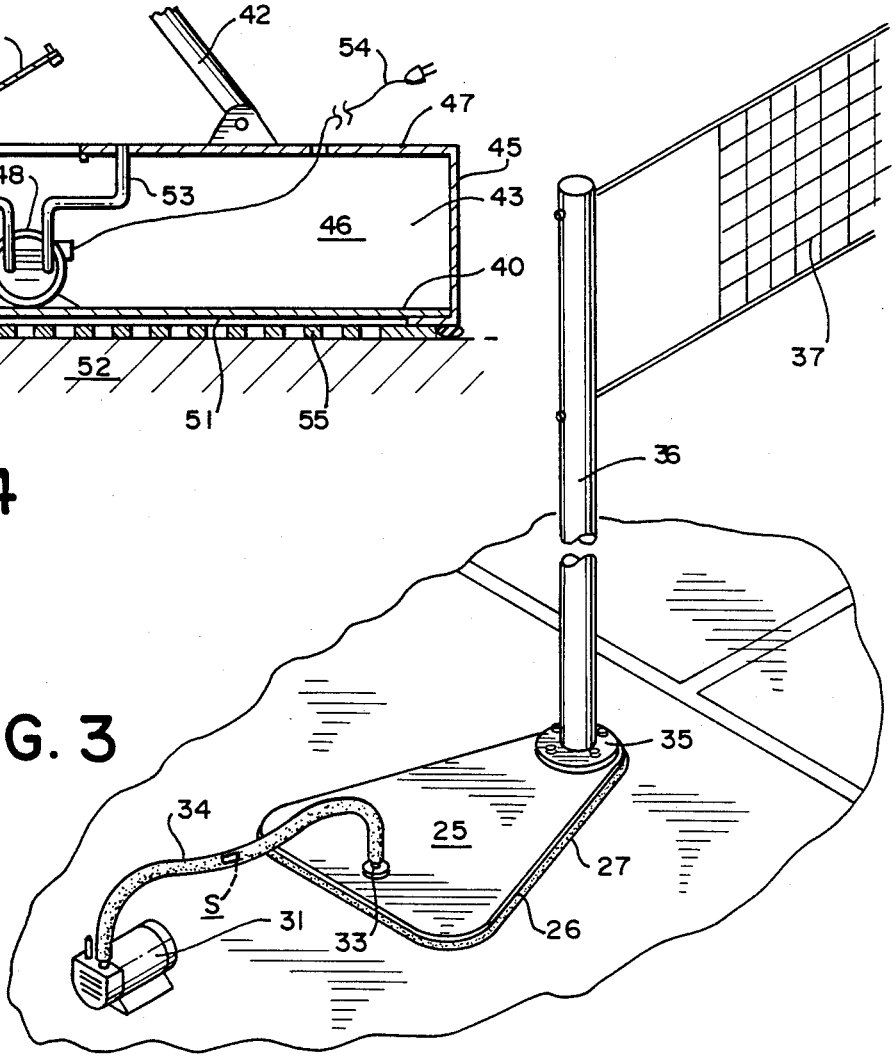
FIG. 3 shows the FIG. 2 structure in perspective supporting one end of a volleyball net.

Another simplified form of the invention is shown in FIGS. 2 and 3 in which a pair of game supports is used to support a volleyball or tennis net. In FIG. 2 a planar metal platform 25 of generally triangular form, as shown in FIG. 3, has its lower periphery indented, as indicated at 26. A rubber O-ring 27 is fitted into the indent, the O-ring 27 being larger than the indent to raise the lower surface 28 of the platform above the floor 29 to define an evacuated space 30.

A vacuum pump 31 which is powered in any desired fashion (usually electrically) is connected to a gas port 32 via an upstanding connector 33 and hose 34 so that a vacuum can be maintained in the space 30.

As shown in FIG. 3, sensor S is located in the tube or hose 34 connecting the vacuum pump 31 with the space 30 between the platform and the floor which is to be evacuated via the upstanding connector 33. As shown in FIG. 2, the sensor S may be alternatively located within the space 30 which is to be evacuated. An electrical connection (no shown) is provided between the sensor S and the vacuum pump 31.

The sensor S is used to monitor the strength of the vacuum and to activate the vacuum pump 31 whenever the pressure rises above the desired value.

The gas port 32 is conveniently positioned at the outer portion of the platform 25 and the inner portion thereof is strengthened at 35 to support a pole 36 to which is attached one end of the net 37 used to play the game.

Figure 4:
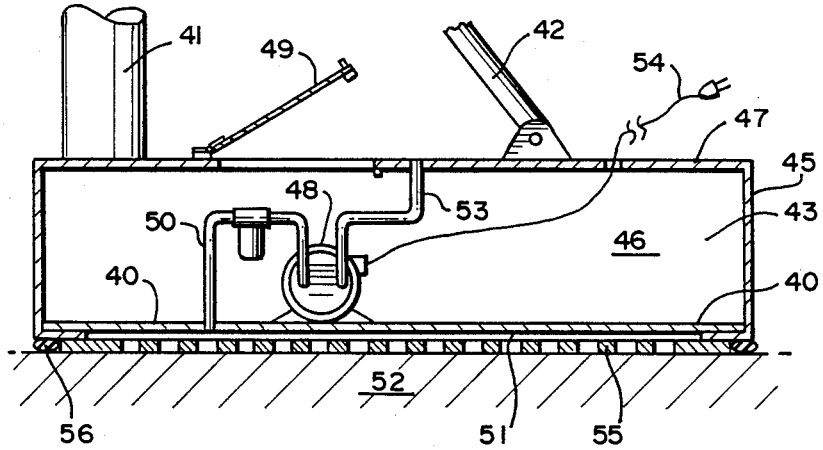
FIG. 4 is a cross-section of another more complex form of the invention in which the vacuum pump is mounted within the platform.

As can be seen in FIG. 4, the platform 40 which carries game supports 41 and 42 is mounted at the bottom of a housing 43 defined by the platform 40, side walls 44 and 45, end walls, such as end wall 46, and a top 47. A vacuum pump 48 is mounted on platform 40 within housing 43, and the top 47 includes an access door 49 to facilitate servicing of the pump.

A tube 50 interconnects pump 48 with an evacuated space 51 beneath the platform and above floor 52, and air outlet 53 allows the air drawn out of space 51 to be exhausted. The pump 48 is electrically powered by means of electrical wire 54.

Platform 40 is supported above a perforated baseplate 55, and a gasket 56 surrounds the perforated baseplate to help seal the structure to the floor.

What is claimed is:

1. In a game-playing apparatus, a combination game equipment, support means comprising column supporting said game equipment in a stationary, elevated position, and a horizontal, rigid, gas-impervious platform, said upper means being mounted near and edge of said platform, means to position said platform above the floor to provide a space therebetween, resilient means surrounding said platform to seal the platform to the floor when the space between the platform and the floor is evacuated, said platform including means for interconnecting the underside of said platform with pump means for providing a desired vacuum to maintain a strong securement between the platform and the floor.

2. A combination as recited in claim 1 in which said pump means is mounted atop said platform.

3. A combination as recited in claim 1 in which said pump means is electrically operated.

4. A combination as recited in claim 1 in which said means for interconnecting the underside of said platform with pump means comprises an upstanding connector to allow said pump means to be tube-connected to the space between said platform and the floor.

5. A combination as recited in claim 1 in which a continuously operated vacuum pump is in communication with the underside of said platform.

6. A combination as recited in claim 1 in which said resilient means extends beneath said platform to position said platform above the floor.

7. A combination as recited in claim 6, further comprising means for sensing the pressure in the space between said platform and the floor, the combination comprising pump means activated by said sensing means to restore the desired vacuum whenever the pressure rises above the desired value.

8. A combination as recited in claim 7 in which said interconnecting means includes said sensing means.

9. A combination as recited in claim 7 in which said sensing means is located within the space between said platform and the floor.

* * * * *